US007878325B2

(12) United States Patent
Flock

(10) Patent No.: US 7,878,325 B2
(45) Date of Patent: Feb. 1, 2011

(54) CONTAINER FOR AN ELONGATED, IRREGULARLY SHAPED OBJECT

(76) Inventor: Timothy Richard Flock, 5237 Rising Sun La., Ellicott City, MD (US) 21043

( * ) Notice: Subject to any disclaimer, the term of this patent is extended or adjusted under 35 U.S.C. 154(b) by 105 days.

(21) Appl. No.: 11/972,842

(22) Filed: Jan. 11, 2008

(65) Prior Publication Data

US 2008/0245688 A1 Oct. 9, 2008

Related U.S. Application Data

(60) Provisional application No. 60/884,788, filed on Jan. 12, 2007.

(51) Int. Cl.
*B65D 85/20* (2006.01)

(52) U.S. Cl. ..... 206/315.1

(58) Field of Classification Search ..... 206/579
See application file for complete search history.

(56) References Cited

U.S. PATENT DOCUMENTS

| | | | | | |
|---|---|---|---|---|---|
| 2,430,905 | A | * | 11/1947 | Bradley | 206/521 |
| 3,877,572 | A | * | 4/1975 | Wiener, Jr. | 206/226 |
| 3,981,402 | A | * | 9/1976 | Miller | 206/534.2 |
| 4,347,934 | A | * | 9/1982 | Goodman | 229/235 |
| 5,447,110 | A | * | 9/1995 | Brown | 141/2 |
| 5,549,196 | A | * | 8/1996 | Kassman | 206/69 |
| 5,794,775 | A | * | 8/1998 | Hall | 206/388 |
| 5,829,629 | A | * | 11/1998 | Usher | 220/724 |

* cited by examiner

*Primary Examiner*—Jacob K Ackun, Jr.
(74) *Attorney, Agent, or Firm*—Norris McLaughlin & Marcus, P.A.

(57) ABSTRACT

A container for an elongated product having an irregular shape, especially, a hockey stick, wherein the container comprises a corrugated tube having sufficient flexibility to conform to the shape of said elongated product and end caps on one or both ends of said tube.

11 Claims, 1 Drawing Sheet

CONTAINER FOR AN ELONGATED, IRREGULARLY SHAPED OBJECT

CROSS-REFERENCE TO RELATED APPLICATIONS

Not applicable.

BACKGROUND OF THE INVENTION

1. Field of the Invention

The present invention relates generally to containers for elongated, irregularly shaped objects, especially hockey sticks.

2. Description of Related Art

Elongated products having irregular shapes, for example, hockey sticks are difficult to transport because of their irregular shapes. Hockey sticks are especially susceptible to breakage when transported with other freight, particularly on airplanes. Current airline policies do not provide for replacement of hockey sticks damaged by the carrier.

Accordingly, there is a need to provide a relatively safe means for transporting hockey sticks and other elongated products having an irregular shape, whether by airplane, bus or other means of transportation, or in shipping via parcel service.

BRIEF SUMMARY OF THE INVENTION

These and other objects were met with the present invention, which provides, in a first embodiment, for a container for an elongated product having an irregular shape, wherein the container comprises a corrugated tube having sufficient flexibility to conform to the shape of said elongated product and end caps on one or both ends of said tube.

The term "elongated" as used herein means that the object has a length many times greater than its width.

The term "irregular shape" as used herein means a shape other than a straight line between two points.

The present invention relates in a second embodiment to said container containing said elongated product having an irregular shape in an interior space of said container.

BRIEF DESCRIPTION OF THE SEVERAL VIEWS OF THE DRAWINGS

One preferred embodiment or a small number of preferred embodiments of the invention will now be described with reference to the drawings, wherein.

Figure 1:
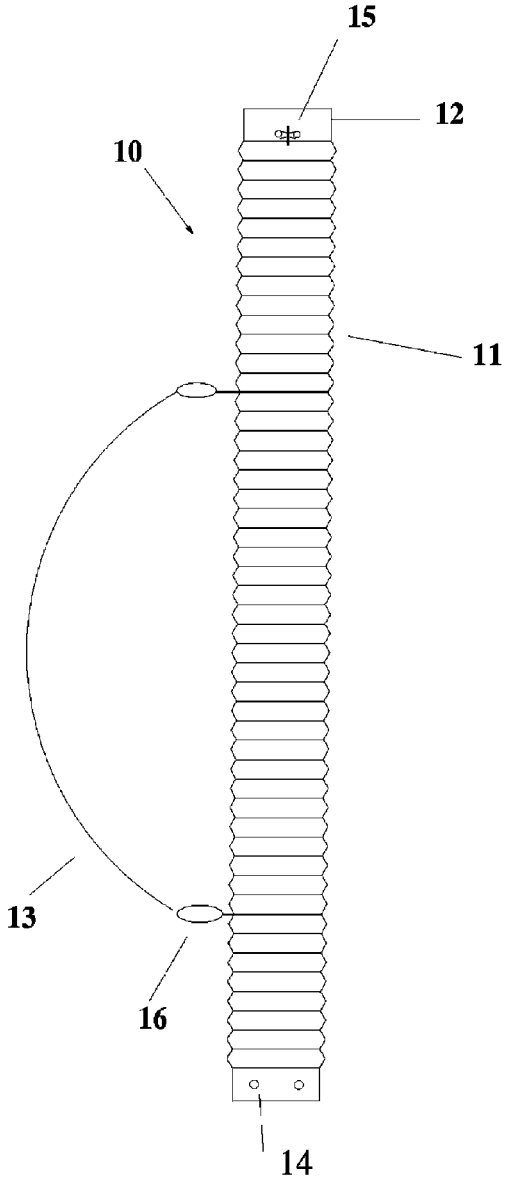
FIG. 1 is a schematic of a container according to the present invention not containing said elongated product having an irregular shape.

It is understood that the references to the drawings herein are meant to be exemplary of the preferred embodiment(s) described herein, and that neither the drawings themselves, nor the reference numerals on the drawings are meant to be limiting of the invention in any respect.

DETAILED DESCRIPTION OF THE INVENTION

The container according to the present invention provides crush strength great enough to reduce or eliminate the breakage of elongated, irregularly shaped objects, especially hockey sticks, during transportation. The container is made of a corrugated material having sufficient flexibility to conform to the shape of the elongated, irregularly shaped object. Any material meeting this requirement can be used, but preference is given to corrugated paper, cardboard or plastic; especially a corrugated plastic; most preferably, a corrugated polyethylene. In a particularly preferred embodiment, the container is made of a corrugated polyethylene tube, as are readily available from any number of manufacturers, for example, ADS or Hancor.

Referring to FIG. 1, the inventive container 10 comprises, in the main, a corrugated polyethylene tube 11, which is a single wall tube, black or some other color, approximately 4 inches in diameter and of a length calculated to be a little bit longer than the total length of a standard hockey stick from handle to blade tip. The corrugated polyethylene tube is fitted with end caps 12 on both ends, the end caps being made of polyethylene as well. One of the end caps serves as a bottom of the container, and, preferably, is permanently fastened to the corrugated polyethylene tube by any suitable means, for example, by aluminum pop rivets 14. The end cap on the other end of the corrugated polyethylene tube serves as the top of the container and is, preferably, repositionable to allow access to an interior space of the corrugated polyethylene tube. The end cap at the top of the container is fitted with a lockable latch 15 preferably made of metal, allowing the container to be securely sealed. To facilitate carrying of the container, the container is provided with a carrying strap 13, which can be attached to the corrugated polyethylene tube by any suitable means, for example, Caribeaner clips 16. The carrying strap can be made of any suitable material, for example, nylon, or bungee-type cords. The strap should be made removable so as not to impede luggage handling equipment at airports or parcel service handling facilities.

Figure 2:
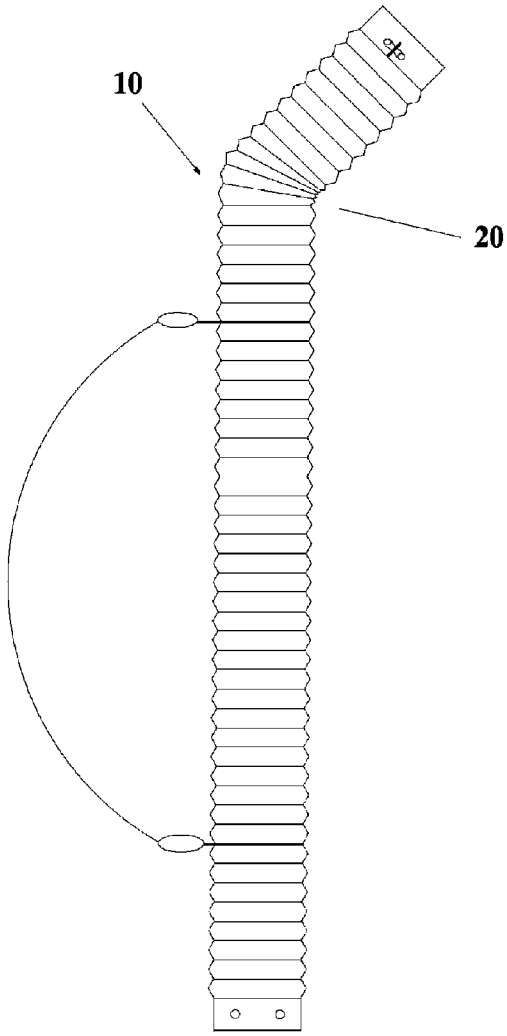
FIG. 2 is a schematic of a container according to the present invention containing said elongated product having an irregular shape.

Referring to FIG. 2, this figure shows the inventive container containing the elongated, irregularly shaped object in its interior space. The configuration explained in the previous paragraph is capable of carrying 1-3 standard size hockey sticks in the interior space. A hockey stick can be dropped into the straight container depicted in FIG. 1 and the container will actually flow around the curvature of the hockey stick until the container covers the entire stick and acquires the shape of the stick including bend 20 as shown in FIG. 2.

It should be understood that the preceding is merely a detailed description of one preferred embodiment or of a small number of preferred embodiments of the present invention and that numerous changes to the disclosed embodiment(s) can be made in accordance with the disclosure herein without departing from the spirit or scope of the invention. The preceding description, therefore, is not meant to limit the scope of the invention in any respect. Rather, the scope of the invention is to be determined only by the appended issued claims and their equivalents.

What is claimed is:

1. A combination comprising:

a) a container comprising a corrugated tube having sufficient flexibility to conform to a shape of an elongated product contained therein and end caps on one or both ends of said tube; and b) an elongated product having a L-shape contained in said container, wherein said elongated product having a L-shape is a hockey stick.

2. The combination according to claim 1, wherein the container comprises end caps on both ends of said tube.

3. The combination according to claim 2, wherein at least one of said end caps is repositionable to allow access to an interior space of said tube.

4. The combination according to claim 3, wherein one of said end caps is fitted with a lockable latch.

5. The combination according to claim 1, wherein the container comprises a strap.

6. The combination according to claim 5, wherein said strap is attached to said tube by means of clips.

7. The combination according to claim 6, wherein said clips are Caribeaner clips.

8. The combination according to claim 1, wherein the container is comprised of a corrugated cardboard or plastic.

9. The combination according to claim 8, wherein the container is comprised of a corrugated plastic.

10. The combination according to claim 9, wherein the corrugated plastic is corrugated polyethylene.

11. A combination comprising:

a) a container comprising:

i) a corrugated polyethylene tube; and ii) end caps on both ends of said tube, at least one of said end caps being repositionable to allow access to an interior space of said tube; and b) a hockey stick in said interior space.

* * * * *